US012268972B1

(12) United States Patent
Shoemaker, Jr.

(10) Patent No.: US 12,268,972 B1
(45) Date of Patent: Apr. 8, 2025

(54) CLAW ARCADE GAME WITH MODIFIED PRIZE SYSTEM

(71) Applicant: Stephen P. Shoemaker Trust, Manhattan Beach, CA (US)

(72) Inventor: Stephen P. Shoemaker, Jr., Redondo Beach, CA (US)

(73) Assignee: Stephen P. Shoemaker Trust, Manhatten Beach, CA (US)

( * ) Notice: Subject to any disclaimer, the term of this patent is extended or adjusted under 35 U.S.C. 154(b) by 0 days.

(21) Appl. No.: 18/882,118

(22) Filed: Sep. 11, 2024

(51) Int. Cl.
*A63F 9/30* (2006.01)

(52) U.S. Cl.
CPC ..... *A63F 9/30* (2013.01)

(58) Field of Classification Search
CPC ..... A63F 9/30
USPC ..... 273/447
See application file for complete search history.

(56) References Cited

U.S. PATENT DOCUMENTS 5,657,995 A * 8/1997 Howard ..... A63F 9/305 446/311
6,085,919 A 7/2000 Singer
6,770,001 B1 * 8/2004 Shoemaker, Jr. ... G07F 11/1657 273/448
8,011,509 B1 * 9/2011 Sakamaki ..... G07F 17/32 273/447
8,210,538 B2 * 7/2012 Shoemaker, Jr. ... G07F 17/3216 273/447
8,251,370 B2 * 8/2012 Guarnieri ..... A63F 9/30 273/447
9,414,699 B2 * 8/2016 Wing ..... A47G 19/2205
10,902,704 B1 1/2021 Shoemaker, Jr.
10,957,165 B2 * 3/2021 Dluzen ..... G07F 17/3297
11,164,428 B1 * 11/2021 Shoemaker, Jr. ... G07F 17/3216
11,615,671 B1 3/2023 Shoemaker, Jr.
2010/0294770 A1 * 11/2010 Wing ..... B65D 17/462 220/270
2013/0214491 A1 8/2013 Shoemaker, Jr.

FOREIGN PATENT DOCUMENTS

JP 2012-5532 A 1/2012

* cited by examiner

*Primary Examiner* — Joseph B Baldori
(74) *Attorney, Agent, or Firm* — Fulwider Patton LLP

(57) ABSTRACT

A claw crane game is disclosed with a modification of a cylindrical prize such as a beverage container used for energy drinks and the like, to facilitate use with a crane arcade game. The modification can be a disk, dome, plate, or similar shape that affixes the upper surface of the cylinder, enabling a claw mechanism to grasp and retain the entire prize. The attachment can be in the form of a screw engagement, press-fit, adhesive, or other releasable connection that allows prizes to be captured and consumed with little inconvenience.

4 Claims, 4 Drawing Sheets

CLAW ARCADE GAME WITH MODIFIED PRIZE SYSTEM

BACKGROUND

Claw-type arcade games, also known as claw machines or skill crane games, have a long and fascinating history in the world of arcade entertainment. The concept of manipulating a claw to grab a prize dates back to the 19th century when early versions of mechanical claw machines were introduced in amusement parks and arcades. These machines were often operated manually and required a great deal of skill to successfully retrieve a prize.

The modern claw-type arcade game as we know it today emerged in the 20th century with the introduction of electromechanical and later fully electronic versions. These machines feature a joystick or button controls that allow players to maneuver a claw over a pile of prizes and attempt to grab one. The claw typically has a limited grip strength and often releases the prize before reaching the prize chute, adding an element of challenge and excitement to the game.

The operation of a claw-type arcade game is relatively simple yet deceptively difficult to master. Players must carefully position the claw over a prize, taking into account factors such as claw strength, positioning, and timing. Once the player activates the claw, it descends and attempts to grab a prize using a combination of grip strength and gravity. Successfully capturing a prize requires a mix of skill, strategy, and a bit of luck.

Claw-type arcade games have become a staple in arcades, amusement parks, and other entertainment venues around the world. These games are popular among players of all ages and have even inspired a competitive subculture of skilled players who specialize in mastering the art of claw machine manipulation. Some arcade owners have even introduced special challenges and prizes for expert players, adding an extra layer of excitement to the gameplay experience.

Despite their simple premise, claw-type arcade games continue to captivate players with their blend of skill, chance, and nostalgia. Whether you're a casual player looking to test your luck or a dedicated enthusiast aiming to conquer the claw, these iconic arcade games offer a timeless and thrilling experience that has endured for generations.

In recent years, crane game owners have sought to attract players with new and different prizes, such as foodstuffs, beverages, and the like. However, the mechanical crane is not well-suited for capturing certain smooth, cylindrical objects that most beverage manufacturers use. Sodas, energy drinks, and various other drinks cannot be used as prizes in an arcade game using the technology that currently exists. The present invention seeks to address this shortcoming.

SUMMARY OF THE INVENTION

The present invention is a modification of a cylindrical prize such as a beverage container used for energy drinks and the like, to facilitate use with a crane arcade game. The modification can be a disk, dome, plate, or similar shape that affixes the upper surface of the cylinder, enabling a claw mechanism to grasp and retain the entire prize. The attachment can be in the form of a screw engagement, press-fit, adhesive, or other releasable connection that allows prizes to be captured and consumed with little inconvenience.

These and other features of the invention will best be understood with reference to the accompanying figures described below and the detailed description of the inventor's preferred embodiments.

DETAILED DESCRIPTION OF THE PREFERRED EMBODIMENTS

Figure 1:
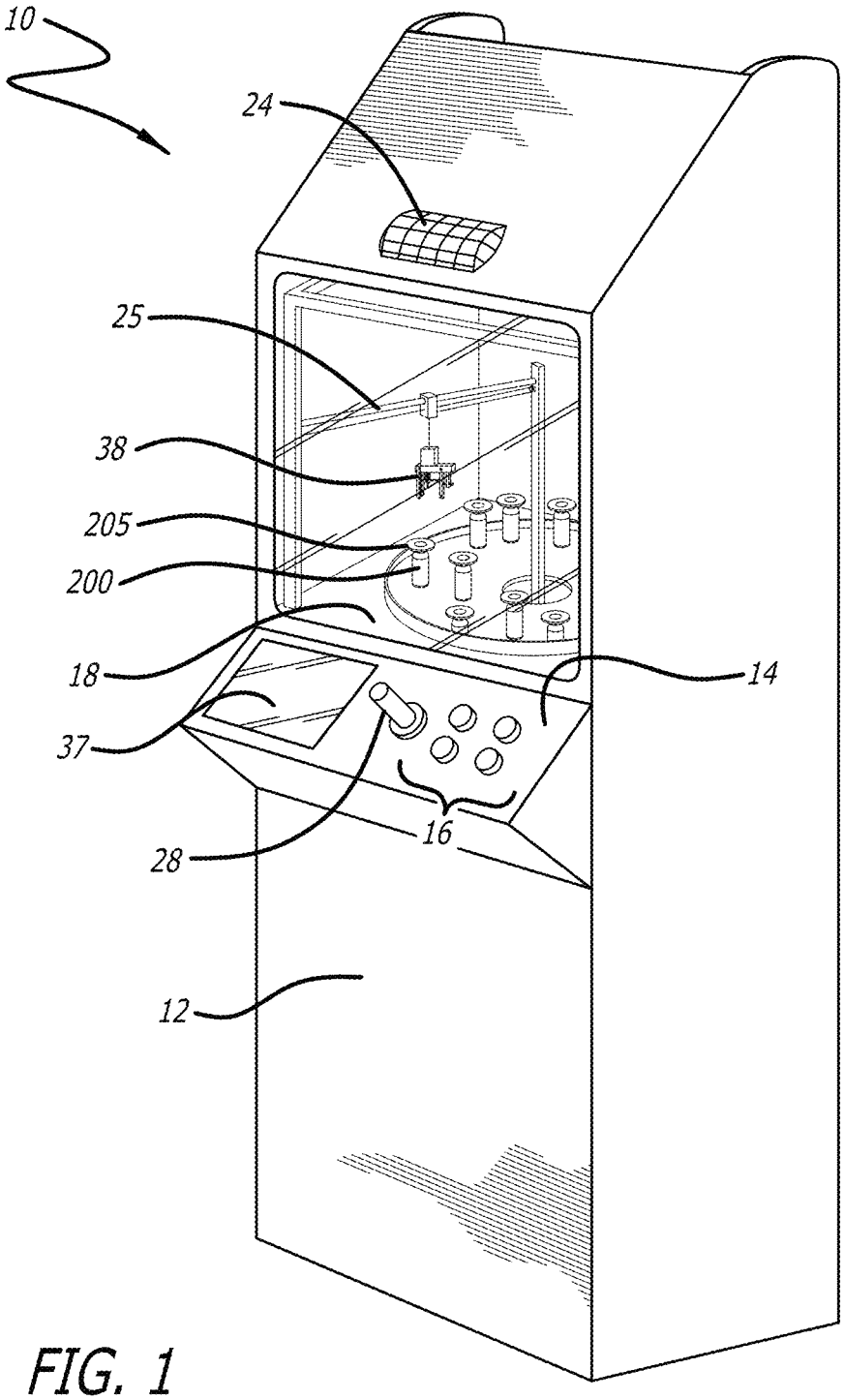
FIG. 1 is an elevated, perspective view of a crane game of the type embodying the present invention.

FIG. 1 illustrates a crane game disclosed in U.S. Pat. No. 11,615,671, the content of which is incorporated herein by reference. The arcade game 10 is housed in cabinet 12 that encloses the other components of the game apparatus. Housings can take a wide variety of forms; for example, as shown in FIG. 1, cabinet 12 may be of the stand-up arcade game variety in which a player stands in front of the game or sits on a stool when playing the game. In other embodiments, other types of housings may be provided. For example, a counter-top housing, including approximately the upper half of cabinet 12 shown in FIG. 1, can be used when the game apparatus is desired to be placed on a table, counter top or other similar surface.

Front panel 14 can be positioned below and/or above the player controls 16 and playing field 18, as shown in FIG. 1. The targets are preferably a type of beverage that is packaged in ubiquitous aluminum cans, small bottles, candy tubes, etc. arranged on a stationary platform or rotating playing field. A pick-up device is used to both capture the targets in the playing field and to deliver any successfully captured prizes from playing field 18 to a player-accessible retrieval bin 20 where the player retrieves the prize. Speaker(s) 24 emits sounds based on game actions and other game states and is controlled by a game control system.

Player controls 16 allow a player to manipulate events in the game, and typically include a joystick, buttons, switch, knob, or the like. Game action occurs in playing field 18, where a pick up mechanism may be controlled and guided by the player to pick up prize objects, as described below. In the embodiment of FIG. 1, a joystick 28 or similar device (knob, two buttons, etc.) can be manipulated by the player to move the pick-up device in a linear direction (forward and backwards) along a fixed support beam 25. Buttons can also be provided to select various game functions, such as additional velocity control of the pick-up device, number of players in a game, a start button to begin the game, etc. For example, in the described embodiment, a stop or slow button can be pressed by the player to slow down (or stop) the rotational movement of a prize turntable so as to allow the player to more accurately position the pick-up device. In alternate embodiments, the player may be able to control motion of other components of the game, such as horizontal or downward movement of the pick-up device. In some embodiments, a player may get multiple chances to guide the pick-up mechanism with one coin or credit, or, alternatively, the player may be required to insert additional coins.

Game playing field 18 is used to display the game action and prizes to a player and is the area where game action occurs. A transparent shield prevents the player from interfering with game action. The playing field 18 includes a turntable-like support 50 that rotates so that every prize falls below or is otherwise accessible to the pick-up device at some point. In some embodiments the player guides the pick-up device 38 horizontally over the playing field, and then either the player or the automatic control of the game lowers the pick-up device 38 over a selected prize in an attempt to capture the prize. If a prize is picked up, the game controller automatically guides the pick-up device 38 with the prize attached to the retrieval bin window 37, which leads to the player's retrieval bin.

Figure 2:
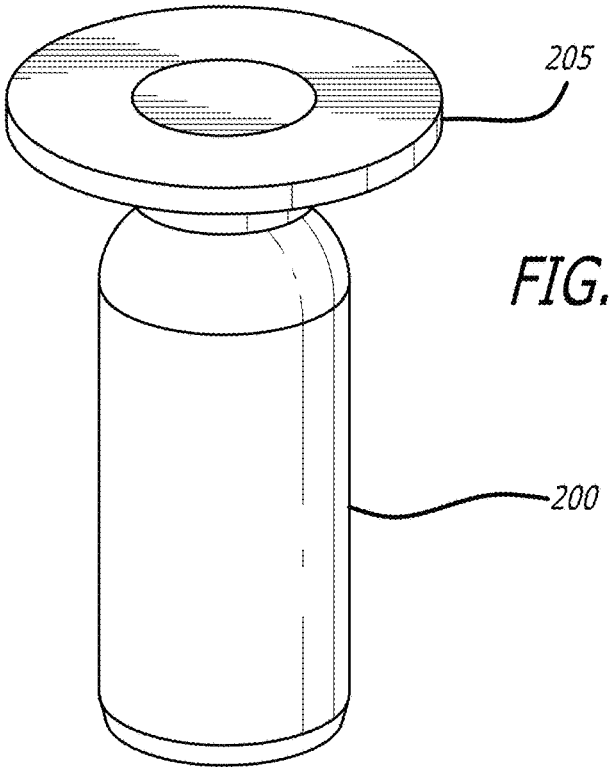
FIG. 2 is an enlarged, perspective view of a capture system for the prize of the game of FIG. 1.
Figure 3:
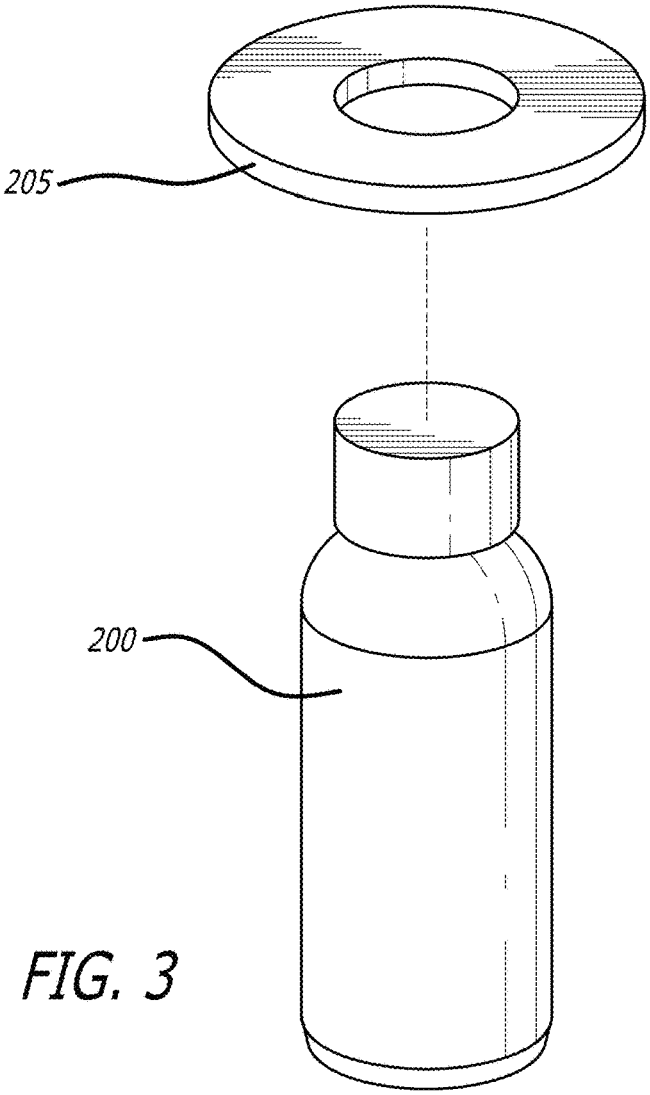
FIG. 3 is an enlarged, exploded view of the prize.

FIGS. 2 and 3 illustrates a target 100 of the present invention comprising a beverage container 200 and an annular disk 205. The disk 205 can be press fit over the lid of the beverage container to provide an circular extension protruding around the upper edge of the beverage container 200 that is more readily engageable by the game's claw.

Figure 4:
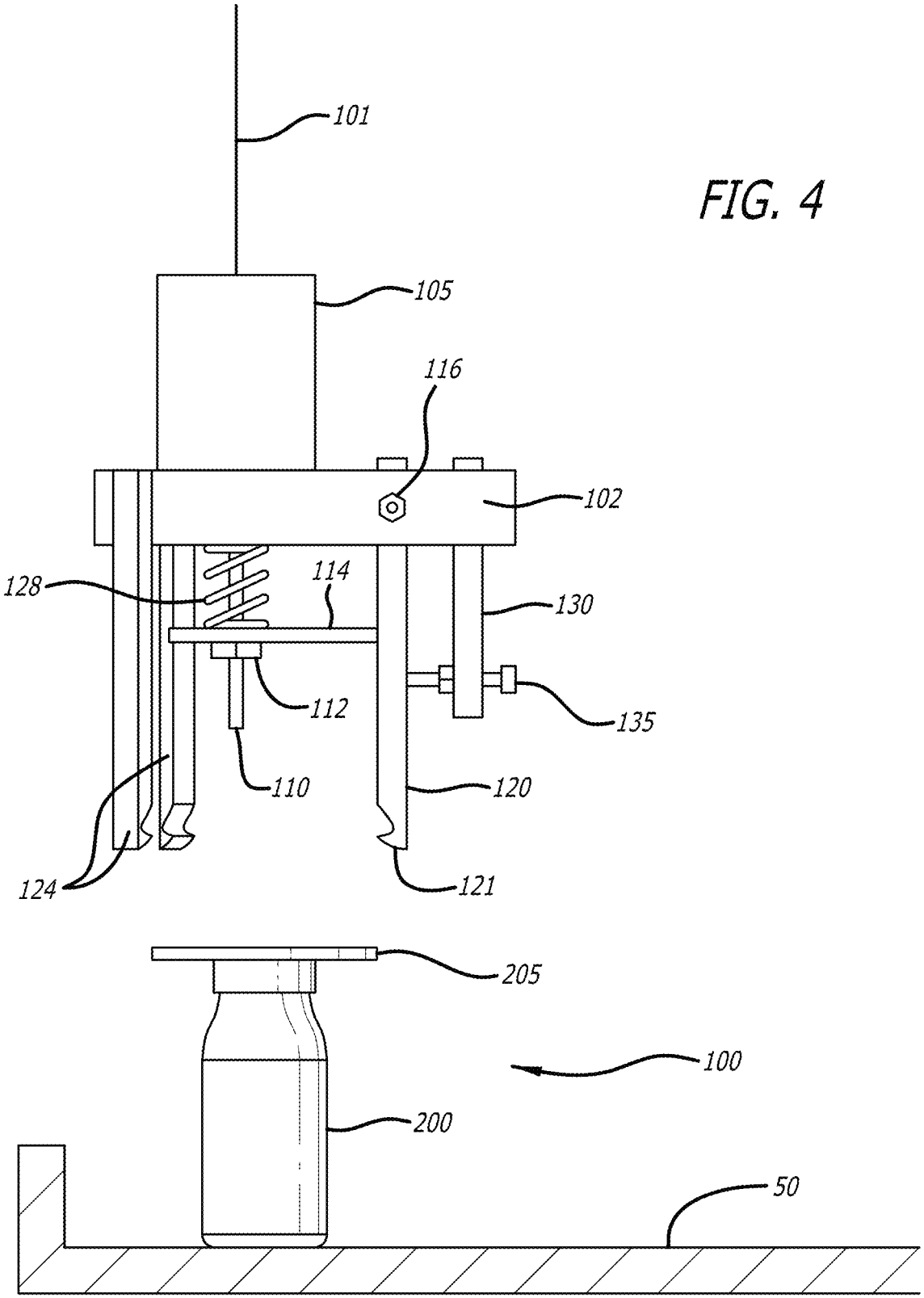
FIG. 4 is a side view of a pick-up mechanism and prize of the present invention.
Figure 5:
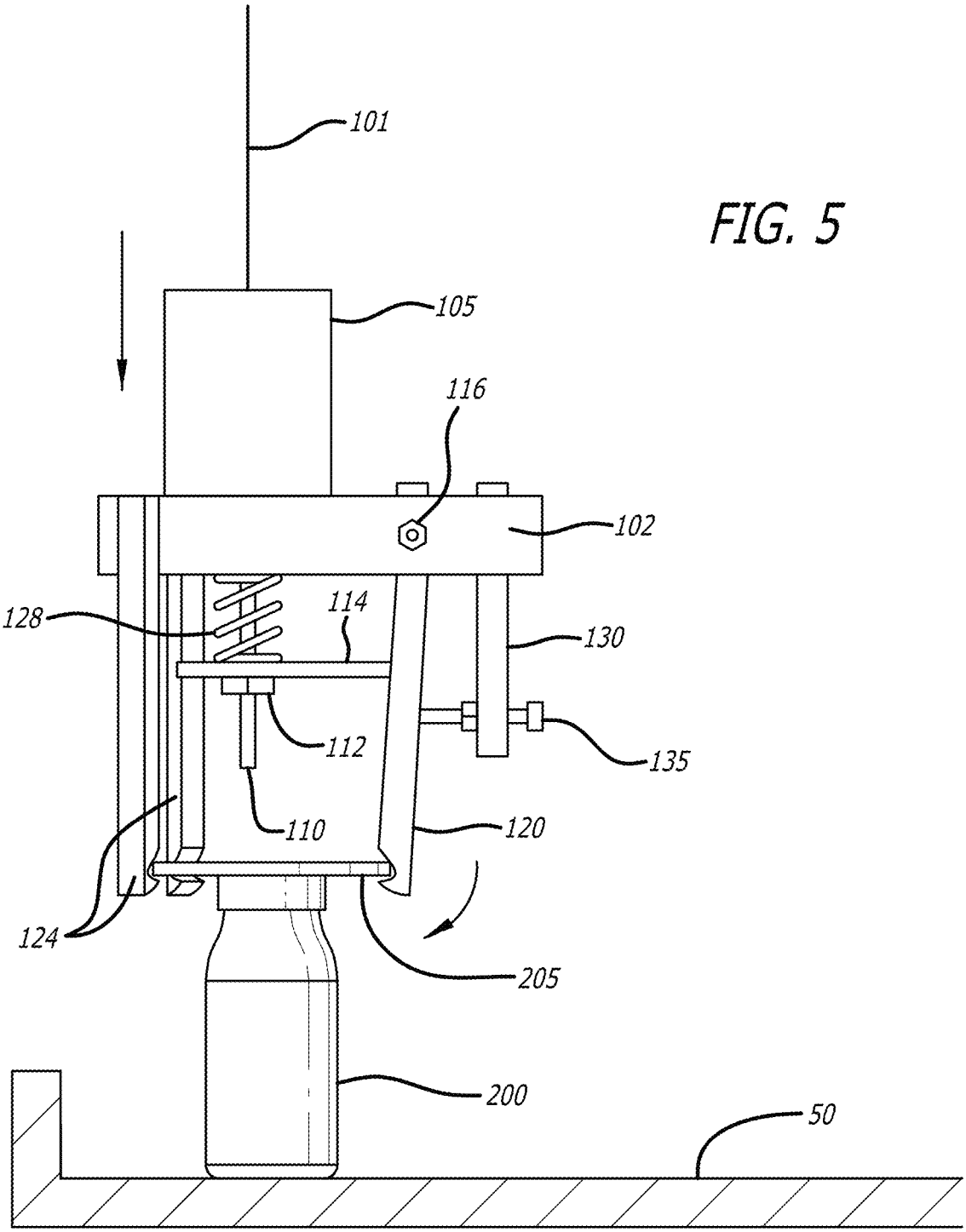
FIG. 5 is a side view showing the pick-up mechanism engaging the prize.

FIGS. 4 and 5 illustrate a pick up device particularly suited for cylindrical targets such as canned beverages, energy drinks, batteries, tube candy packages, and the like. The targets 100 are arranged on the support 50 below the pick-up device 38, which in this case is a mechanical claw capable of clamping onto the targets 100. When the pick-up device is lowered onto the target 100, a pivoting prong rotates into engagement with the annular disk 205 affixed to the bottle 200 if the pick-up device is properly positioned by the player. Screws may be added to incorporate player adjustment to the game but the advantage cannot be changed during play. Once the target 100 is acquired by the solenoid actuated mechanical claw, it is lifted off the support 50 and moved to a retrieval bin where it can be collected by the player.

The mechanical claw pick-up device is suspended by a cable 101 and includes a platform 102 in the form of a frame. Mounted to the frame is a twelve volt solenoid 105 configured to withdraw a rod 110. The rod 110 is extended in the unbiased condition and retracted when the solenoid 105 is actuated. On the distal end of the rod 110 is a threaded portion onto which a nut 112 is placed. The nut 112 bears against a rigid plank 114 with a forked end through which the rod 110 passes. The opening in the fork is wide enough to pass the threaded portion of the rod but not the nut 112, so when the rod is retracted, the nut pushes up the rigid plank 114 and pivots the plank 114 about pin 116. The plank 114 is connected to a prong 120 of the mechanical claw, such that the end 121 of the prong 120 rotates toward the other two prongs 124 when the plank 114 is raised by the rod 110. A coil spring 128 is disposed between the solenoid 105 and the plank 114 to push the plank away from the solenoid, which in turn rotates the pivoting prong 120 away from the other two prongs 124. The distance between the pivoting prong 120 and the other two prongs 124 (or other rigid support) determines the clearance for the player to capture a target 100. A stop 130 is mounted to the platform 102 behind the prong 120 to establish the maximum outward deflection of the moving prong 120 when the spring is fully extended. Here, the stop 130 is adjustable using a threaded fastener 135 so as to make the width between the prong 120 and the other two prongs 124. By setting this distance judiciously, the game proprietor can vary the difficulty of the game by managing the clearance between the prongs and the diameter of the disk 205. In some embodiments, the two fixed prongs 124 can be replaced with a curved plate or other backstop to prevent the prize from moving or tilting backwards in response to the movement of the movable prong 120.

The solenoid is energized by a twelve VDC voltage that is converted from a signal sent along the cable 101 by the game's processor. When the movable prong is rotated or pivoted against the target 100, the notched or barbed end of the prongs 120, 124 engage and capture the disk 205 of the bottle 200 and allow the target to be raised by the pick-up device. The notching at the bottom of the prongs permits the disk of the target to rest its physical weight upon the notching and therefore relies significantly less on the closure grip strength of the pick-up device. This allows significantly heavier prizes to be captured when compared with claws or traditional design. With tubular candy packages, the prizes are very light weight and a notch is unnecessary to capture and lift the target.

FIG. 5 illustrates the positioning of the pick-up device 38 at the target's upper surface. The distance between the moving prong 120 and the fixed prongs 124 establish the margin for which the player has to position the claw over the target 100. If the pick-up device is not positioned so as to allow the target to fit between the prong 120 and the prongs 124, the target cannot be acquired and the attempt will fail. If the player is successful in positioning the ends of the prongs as shown in FIG. 3, the mechanism is in position to engage the disk 205 and acquire the target 100. An electronic signal is sent along the cable 101 to the solenoid 105, which in turn retracts the rod 110. The movement of the rod 110 and the nut 112 lifts the plank 114, causing the plank and the prong 120 to pivot inward about pin 116 (see FIG. 4). Rotation of the prong 120 causes the lip of the target to be engaged by the barb or notch 165 of the prong 120, securing the target to the pick-up device. The pick-up device is now raised and carried to the retrieval bin where it can be collected by the player. The electronic signal, sent along cable 101 to the solenoid 105, is discontinued which in turn de-energizes the solenoid causing the rod 110 to release the prize.

The shape of the disk 205 can vary and be in the shape of a dome, disk, plate, or the like, as long as it can be affixed to and easily removed from the bottle 200 while still maintaining sufficient strength to not disengage when lifted by the claw.

While the foregoing described the inventor's preferred embodiments, it is understood that other variations are possible and would be apparent to one of ordinary skill in the art. The scope of the invention is intended to include all such variations. Unless specifically stated herein, no depiction or description of the preferred embodiments should be considered limiting or exclusive. Rather, the scope of the invention is properly determined by the words of the appended claims using their customary and ordinary meanings.

I claim:

1. A claw arcade game, comprising:

a housing;

a claw pick-up device;

player controls for maneuvering the claw pick-up device;

a plurality of prizes arranged in the housing, said prizes constituting an array of cylindrical beverages including a cylindrical cap; and a disk attachable to an upper surface of each cylindrical cap, said disk having a diameter greater than a diameter of the cylindrical beverages;

wherein said claw pick-up device is configured to make contact with the disk and not the cylindrical beverage, and to lift the cylindrical beverage via the disk.

2. The claw arcade game of claim 1, wherein the disk is affixed to the cylindrical cap via a threaded engagement.

3. The claw arcade game of claim 1, wherein the disk is affixed to the cylindrical cap via a press-fit engagement.

4. The claw arcade game of claim 1, wherein the disk is affixed to the cylindrical cap via an adhesive engagement.

* * * * *